US011589643B2

(12) United States Patent
Whitley

(10) Patent No.: US 11,589,643 B2
(45) Date of Patent: Feb. 28, 2023

(54) ATHLETIC FOOTWEAR ARTIFICIAL LIGAMENT DEVICE AND APPARATUS

(71) Applicant: Brent J. Whitley, Arvada, CO (US)

(72) Inventor: Brent J. Whitley, Arvada, CO (US)

( * ) Notice: Subject to any disclaimer, the term of this patent is extended or adjusted under 35 U.S.C. 154(b) by 344 days.

(21) Appl. No.: 16/857,887

(22) Filed: Apr. 24, 2020

(65) Prior Publication Data

US 2020/0245714 A1 Aug. 6, 2020

Related U.S. Application Data

(63) Continuation of application No. 15/844,993, filed on Dec. 18, 2017, now abandoned.

(51) Int. Cl.

| | |
|---|---|
| ***A43B 7/20*** | (2006.01) |
| ***A43B 7/22*** | (2006.01) |
| ***A43B 7/14*** | (2022.01) |
| ***A43B 3/16*** | (2022.01) |

(52) U.S. Cl.

CPC ..... *A43B 7/20* (2013.01); *A43B 7/226* (2013.01); *A43B 3/163* (2013.01); *A43B 7/1495* (2013.01)

(58) Field of Classification Search

CPC ..... A43B 3/163; A43B 7/226; A43B 7/20; A43B 7/1495

USPC ..... 36/89

See application file for complete search history.

(56) References Cited

U.S. PATENT DOCUMENTS

| | | | | |
|---|---|---|---|---|
| 4,753,229 | A * | 6/1988 | Sutherland | A61F 13/066 602/65 |
| 4,922,630 | A * | 5/1990 | Robinson | A43B 5/00 36/89 |
| 5,672,156 | A | 9/1997 | Jimenez Ramos | |
| 5,771,608 | A * | 6/1998 | Peterson | A43C 11/00 36/89 |
| 6,299,587 | B1 * | 10/2001 | Birmingham | A61F 5/0127 602/5 |
| 6,503,218 | B1 * | 1/2003 | Ascheman | A61F 5/0111 602/23 |
| 7,171,766 | B2 * | 2/2007 | Bouche | A43B 1/0081 602/65 |
| 7,905,850 | B2 | 3/2011 | Norton | |
| 2005/0177083 | A1 * | 8/2005 | Heil | A61F 5/0111 602/27 |
| 2005/0198869 | A1 * | 9/2005 | Bouche | A43B 1/0081 36/89 |

(Continued)

*Primary Examiner* — Alissa J Tompkins
*Assistant Examiner* — Catherine M Ferreira
(74) *Attorney, Agent, or Firm* — Acuity IP, LLC; Nathan S. Cassell

(57) ABSTRACT

An athletic footwear artificial ligament device includes a flexible band securable around a lower leg above an ankle of a foot of a wearer, a ring disposable adjacent an outer side of the ankle spaced below the flexible band, and a plurality of artificial ligaments coupled to and arrayed about the ring. An upper artificial ligament is attached to the flexible band and extends downward to the ring. A lower artificial ligament is attachable to an upper of the athletic shoe, adjacent to the sole and above the heel, and extends upward to the ring. A forward artificial ligament is attachable to the athletic shoe upper forwardly of the ring, above the sole and spaced forwardly from the heel, and extends rearward to the ring such that the artificial ligaments perform as a second set of ligaments providing sprain protection of the ankle of the foot of the wearer.

6 Claims, 7 Drawing Sheets

(56) References Cited

U.S. PATENT DOCUMENTS

| | | | | |
|---|---|---|---|---|
| 2010/0036304 | A1* | 2/2010 | Norton | A43C 11/1493 602/65 |
| 2014/0223775 | A1 | 8/2014 | Fleuren | |

* cited by examiner

ATHLETIC FOOTWEAR ARTIFICIAL LIGAMENT DEVICE AND APPARATUS

CROSS-REFERENCES TO RELATED APPLICATIONS

This application is a continuation of U.S. patent application Ser. No. 15/844,993 filed Dec. 18, 2017, the content of which is incorporated herein by reference.

FIELD OF THE INVENTION

The present invention relates to athletic footwear with ankle sprain protection and, more particularly, is concerned with an athletic footwear artificial ligament device and apparatus that preserves the total range of motion of the wearer.

BACKGROUND OF THE INVENTION

Extreme or abnormal pronation with or without plantar flexion, resulting in a sprain of one or more of the ligaments of the ankle joint, is one of the most frequent injuries experienced by both professional and non-professional athletes. A traditional approach used by many to minimizing the risk of incurring a sprained ankle is through the employment of athletic tape by immobilizing the ankle. However, this process is very time consuming and must be done properly by a trained professional otherwise in order for it to work properly.

Alternatively, there are those who prefer to utilize a wearable support system (e.g. an ankle brace) that can be easily wrapped and tightened around the ankle to be selectively worn in the inside of an athletic shoe so as to immobilize the ankle joint against abnormal rotation. However, this type of approach is uncomfortable for some making it unbearable to wear during a physical activity. Although both solutions offer different approaches on how to reinforce and restrict the ankle to minimize the hyperextension of the ankle ligaments, they each suffer from similar drawbacks. For example, both the tape and ankle brace are uncomfortable, time consuming to employ, expensive and cause the loss of normal range of motion. The loss of range of motion affects agility, athletic ability, and increases the external forces imposed on other joints as they overcompensate for the force in the kinetic chain that is passed upward due to the restriction of the ankle. This is the reason why so many high ankle and knee injuries occur.

As a result additional approaches have been produced in hopes of reducing the likelihood of ankle sprain occurrences. Some approaches are disclosed in U.S. Pat. Nos. 4,922,630, 7,171,766 and U.S. Pat. Appl. Pub. No. 2014/0223775. However, all of these prior art approaches all appear to have the same residual downfall of their counterpart (i.e. they are all focused on overly restricting the normal range of motion of the ankle). Therefore, the ongoing issue of reoccurring orthopedic injuries remains.

Accordingly, there is a long felt, as of yet unmet, need for an improved athletic footwear apparatus in the art that overcomes potential deficiencies of these past approaches and addressed the problems that may still be unsolved.

BRIEF SUMMARY OF THE INVENTION

The present invention is directed to an innovation that provides an athletic footwear artificial ligament device and apparatus to overcome the deficiencies of past approaches and problems that remain unsolved.

In one aspect of the present invention, an athletic footwear artificial ligament device includes: an elongated flexible band securable around a lower leg and above an ankle of a foot of a wearer; a ring disposable adjacent an outer side of the ankle and spaced below the elongated flexible band; and a plurality of artificial ligaments coupled to and arrayed about the ring, the plurality of artificial ligaments including an upper artificial ligament attached to the elongated flexible band and extending downward to the ring, a lower artificial ligament attachable to an upper of the athletic shoe, adjacent to a sole and above a heel of the sole of the athletic shoe, and extending upward to the ring, and a forward artificial ligament attachable to the upper of the athletic shoe forwardly of the ring, above the sole and spaced forwardly from the heel of the athletic shoe, and extending rearward to the ring such that the upper, lower and forward artificial ligaments perform as a second set of ligaments providing sprain protection of the ankle of the foot of the wearer.

In another aspect of the present invention, the elongated flexible band is an elongated strap of inelastic flexible material having portions that overlap to enable securing the elongated flexible band around the lower leg of the wearer. The elongated flexible band has patches of hook and loop materials on opposite sides of the elongated flexible band that enables the portions of the elongated flexible band that overlap to detachably attach to one another. The ring is made of a rigid material and has a circular configuration.

In another aspect of the present invention, the upper artificial ligament includes an upper elongated strip of inelastic flexible material having a first end attached to the elongated flexible band, and a loop of inelastic flexible material attached to a second end of the upper elongated strap of inelastic flexible material and coupled about the ring at an upper portion thereof.

In another aspect of the present invention, the lower artificial ligament includes a lower elongated strip of inelastic flexible material having a first end attachable to the upper of the athletic shoe adjacent to the sole and above the heel of the sole of the athletic shoe, and a loop of inelastic flexible material attached to a second end of the lower elongated strap of inelastic flexible material and coupled about the ring at a lower portion thereof. The upper and lower elongated strips of flexible materials are respectively extendable above and below the ring in vertical alignment with each other along and adjacent the outer side of the ankle of the one foot of the wearer.

In another aspect of the present invention, the forward artificial ligament includes a forwardly-declining elongated strip of inelastic flexible material having a first end attachable to the upper of the athletic shoe forwardly of the ring, above the sole and spaced forwardly from the heel of the sole of the athletic shoe, and a loop of inelastic flexible material attached to a second end of the forwardly-declining elongated strip of inelastic flexible material and coupled about the ring at forward portion thereof.

In another aspect of the present invention, the athletic footwear artificial ligament device includes an elongated retention member surrounding the elongated flexible band adjacent to an end portion thereof so as to enable overlapping and securing of the end portion of the elongated flexible band with an adjacent portion of elongated flexible band.

In another aspect of the present invention, an athletic footwear artificial ligament apparatus includes: an athletic shoe including a sole, and an upper attached to and extending upwardly from the sole, the upper having portions for fastening the athletic shoe on and about a foot of a wearer; and an athletic footwear artificial ligament device including an elongated flexible band securable around a lower leg and above an ankle of a foot of a wearer and above the athletic shoe when on the foot of the wearer, a ring made of a rigid material and having a circular configuration, the ring being disposable adjacent an outer side of the ankle and spaced below the elongated flexible band, and a plurality of artificial ligaments coupled to and arrayed about the ring, the plurality of artificial ligaments including an upper artificial ligament attached to the elongated flexible band and extending downward to the ring, a lower artificial ligament attached to the upper of the athletic shoe, adjacent to the sole and above a heel of the sole of the athletic shoe, and extending upward to the ring, and a forward artificial ligament attached to the upper of the athletic shoe forwardly of the ring, above the sole and spaced forwardly of the heel of the athletic shoe, and extending rearward to the ring such that the upper, lower and forward artificial ligaments perform as a second set of ligaments providing sprain protection of the ankle of the foot of the wearer.

In another aspect of the present invention, an athletic footwear artificial ligament apparatus includes: an athletic shoe including a sole, an upper attached to and extending upwardly from the sole, the upper having portions for fastening the athletic shoe on and about a foot of a wearer, and a plurality of first connectors, one of the first connectors being attached on the upper of the athletic shoe adjacent to the sole and above a heel of the sole of the athletic shoe, and the other of the first connectors being attached to the upper of the athletic shoe forwardly of the ring and above the sole and spaced forwardly of the heel of the sole of the athletic shoe; and an athletic footwear artificial ligament device including an elongated flexible band securable around a lower leg and above an ankle of a foot of a wearer and above the athletic shoe when on the foot of the wearer, a ring made of a rigid material and having a circular configuration, the ring being disposable adjacent an outer side of the ankle and spaced below the elongated flexible band, and a plurality of artificial ligaments coupled to and arrayed about the ring, the plurality of artificial ligaments including an upper artificial ligament having one of a plurality of second connectors thereon being detachably attached to the elongated flexible band and extending downward to the ring, a lower artificial ligament having another of the plurality of second connectors thereon being detachably attached to the one of the first connectors on the upper of the athletic shoe with the lower artificial ligament extending upward to the ring, and a forward artificial ligament having another of the plurality of second connectors thereon being detachably attached to the other of the first connectors on the upper of the athletic shoe with the forward artificial ligament extending rearward to the ring, such that the upper, lower and forward artificial ligaments perform as a second set of ligaments providing sprain protection of the ankle of the foot of the wearer.

In another aspect of the present invention, the upper artificial ligament includes an upper elongated strip of inelastic flexible material having a first end with one of the plurality of second connectors thereon detachably attached to the elongated flexible band, and a loop of inelastic flexible material attached to a second end of the upper elongated strap of inelastic flexible material and coupled about the ring at an upper portion thereof.

In another aspect of the present invention, the lower artificial ligament includes a lower elongated strip of inelastic flexible material having a first end with the another of the plurality of second connectors thereon detachably attached to the one of the pair of first connectors on the upper of the athletic shoe, and a loop of inelastic flexible material attached to a second end of the lower elongated strap of inelastic flexible material and coupled about to the ring at a lower portion of the ring. The upper and lower elongated strip of inelastic flexible material are respectively extendable above and below the ring in vertical alignment with each other along and adjacent the outer side of the ankle of the foot of the wearer.

In another aspect of the present invention, the forward artificial ligament includes a forwardly-declining elongated strip of inelastic flexible material having a first end with still another of the plurality of second connectors thereon detachably attached to the other of the plurality of first connectors on the upper of the athletic shoe, and a loop of inelastic flexible material attached to a second end of the forwardly-declining elongated strip of inelastic flexible material and coupled about the ring at a forward portion thereof.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
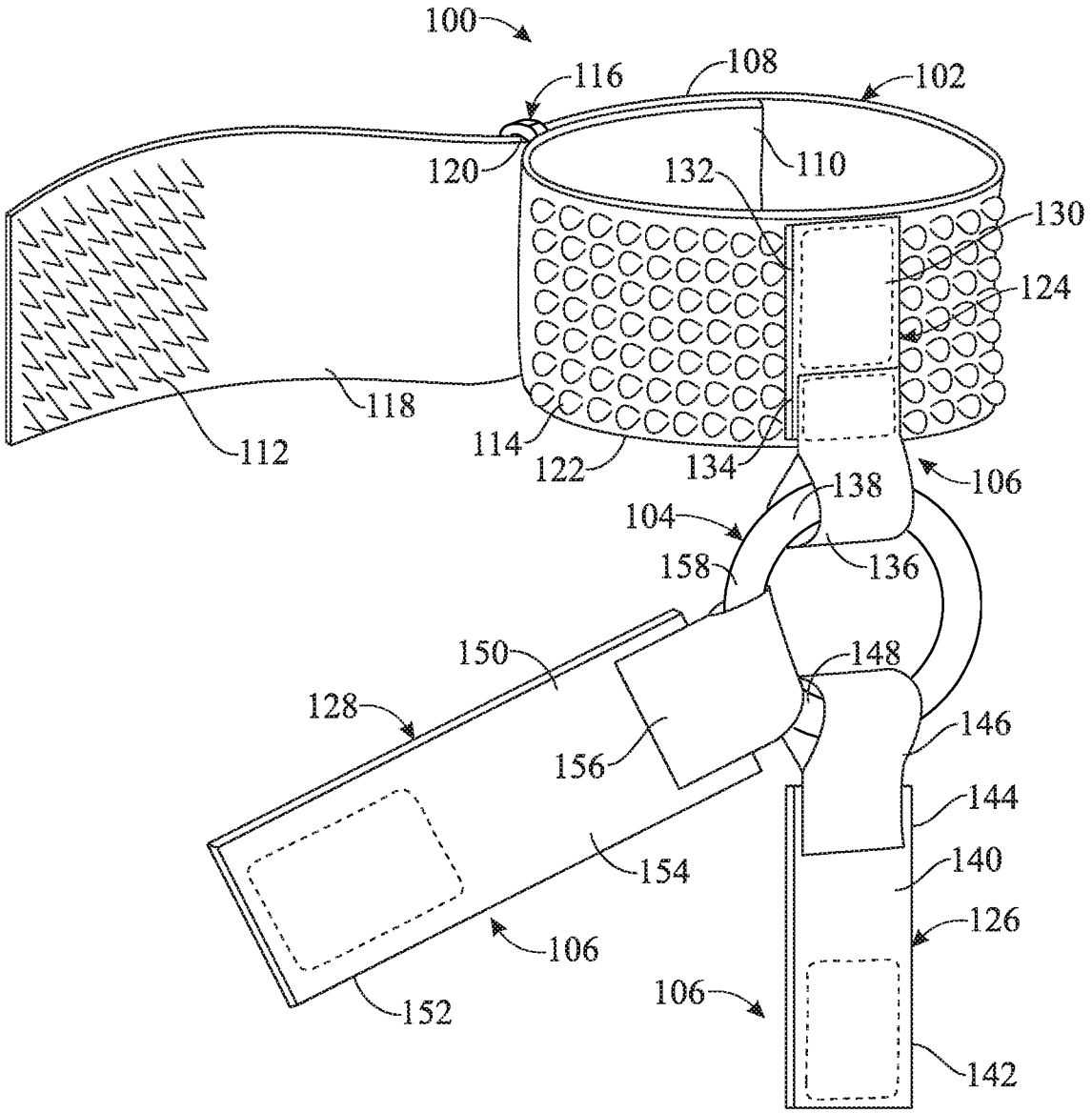
FIG. 1 presents an isometric view of an exemplary embodiment of an athletic footwear artificial ligament device in accordance with aspects of the present invention.

Referring now to FIG. 1, there is illustrated an exemplary embodiment of an athletic footwear artificial ligament device, generally designated 100, in accordance with aspects of the present invention. The device 100 includes an elongated flexible band 102, a ring 104, and a plurality of artificial ligaments 106. The ring 104 and the plurality of artificial ligaments 106 extend between and interconnect the elongated flexible band 102 and an athletic shoe 200, as seen in FIGS. 2-7. The athletic shoe 200 has a bottom sole 202, a heel 204 at the rear portion of the sole, and an upper 206 attached to and extending upwardly from the sole. The athletic shoe upper 206 has portions, such as laces 208, used for fastening the athletic shoe 200 on and about a foot 300 of a wearer.

More particularly, the elongated flexible band 102 of the device 100 is securable around a lower leg 302 and above an ankle 304 of the foot 300 of the wearer. The elongated flexible band 102 is an elongated strap of inelastic flexible material having portions 108, 110 that overlap one another to enable securing the elongated flexible band around the lower leg 302 of the wearer. The elongated flexible band 102 has patches of hook and loop materials 112, 114 on opposite sides of the elongated flexible band that enable the portions 108, 110 of the elongated flexible band that overlap to detachably attach to one another.

Figure 2:
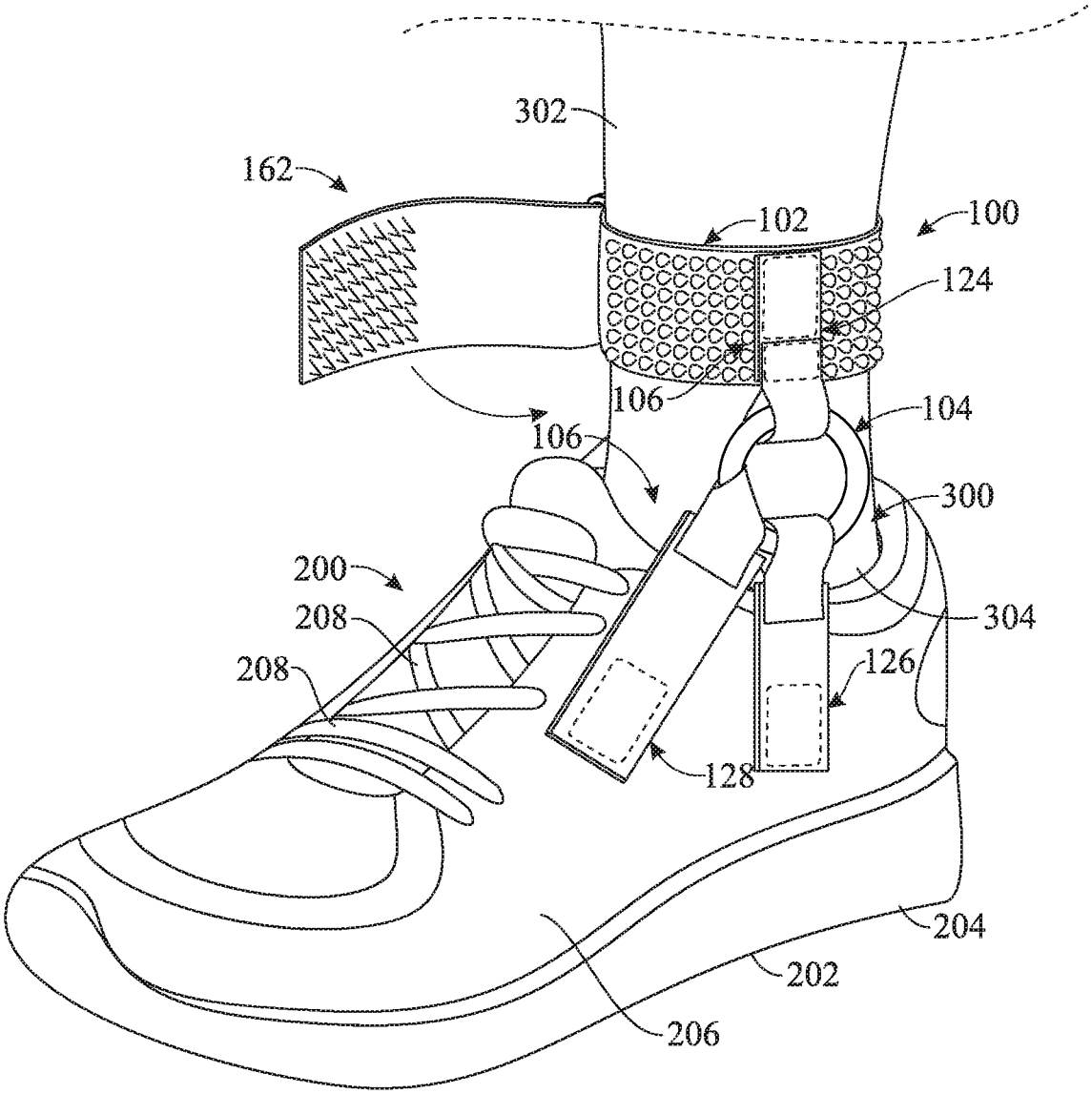
FIG. 2 presents an isometric view of the device originally introduced in FIG. 1, illustrating a plurality of artificial ligaments of the device permanently attached to athletic footwear and an elongated flexible band of the device in unfastened condition about a lower leg and above an ankle of a wearer.

The device 100 also has an elongated retention member 116 that fits around, or surrounds, sections of the overlapped outer and inner portions 108, 110 of the elongated flexible band 102 adjacent to an end portion 118 thereof. The elongated retention member 116 is attached to the inner portion 110 of the elongated flexible band 102 so as to create a gap 120 through the elongated retention member along the exterior of the inner portion of elongated flexible band through which the end portion 118 thereof may be inserted so that it extends freely forwardly from the elongated retention member as the elongated flexible band 102 is firmly applied about the lower leg 302 of the wearer. The elongated retention member 116 confines the end portion 118 in a position near the elongated flexible band 102, as seen in FIGS. 1 and 2, that enables overlapping and securing of the end portion with an adjacent portion 122 of the elongated flexible band and thereby securing of the adjacent patches of hook and loop materials 112, 114 to one another.

The ring 104 of the device 100 is made of a rigid material, such as a suitable nonflexible plastic or metal material, and has a circular configuration. The ring 104 is disposable adjacent an outer side of the ankle 304 and also of the athletic shoe 200 when the athletic shoe is on the foot 300 of the wearer. Also, the ring 104 is spaced below the elongated flexible band 102. The plurality of artificial ligaments 106 of the device 100 are coupled to and slidably arrayed about the ring 104. The plurality of artificial ligaments 106 includes an upper artificial ligament 124, a lower artificial ligament 126, and a forward artificial ligament 128. The upper artificial ligament 124 of the plurality of artificial ligaments 106 is attached, such as by stitching, to the elongated flexible band 102 and extends downward to the ring 104.

More specifically, the upper artificial ligament 124 includes an upper elongated strip 130 of inelastic flexible material having opposite first and second ends 132, 134, and a loop 136 of inelastic flexible material. The first end 132 of the upper elongated strip 130 of inelastic flexible material is attached, such as by stitching, to the elongated flexible band 102. The loop 136 of inelastic flexible material is attached to the second end 134 of the upper elongated strip 130 of inelastic flexible material. The loop 136 of inelastic flexible material is coupled and slidably moveable about the ring 104 at an upper portion 138 thereof.

The lower artificial ligament 126 of the plurality of artificial ligaments 106 is attachable to the upper 206 of the athletic shoe 200, adjacent to the sole 202 and above the heel 204 of the athletic shoe, and extends upward to the ring 104. More specifically, the lower artificial ligament 126 includes a lower elongated strip 140 of inelastic flexible material having opposite first and second ends 142, 144, and a loop 146 of inelastic flexible material. The first end 142 of the lower elongated strip 140 of inelastic flexible material is attachable to the upper 206 of the athletic shoe 200 adjacent to the sole 202 and above the heel 204 thereof. The loop 146 of inelastic flexible material is attached to the second end 144 of the lower elongated strip 140 of inelastic flexible material. The loop 146 of inelastic flexible material is coupled and slidably moveable about the ring 104 at a lower portion 148 thereof. Furthermore, the upper and lower elongated strips 130, 140 of inelastic flexible materials are respectively extendable above and below the ring 104 in vertically alignment with each other along and adjacent to the outer side of the ankle 304 of the foot 300 of the wearer.

The forward artificial ligament 128 of the plurality of artificial ligaments 106 is attachable to the upper 206 of the athletic shoe 200 forwardly of the ring 104, above the sole 202 and spaced forwardly from the heel 204 of the athletic shoe 200, and extends rearward to the ring 104. More specifically, the forward artificial ligament 128 includes a forwardly-declining elongated strip 150 of inelastic flexible material having opposite first and second ends 152, 154, and a loop 156 of inelastic flexible material. The first end 152 of the forwardly-declining elongated strip 150 of inelastic flexible material is attachable to the upper 206 of the athletic shoe 200 forwardly of the ring 104, above the sole 202 and spaced forwardly from the heel 204 of the athletic shoe 200. The loop 156 of inelastic flexible material is attached to the second end 154 of the forwardly-declining elongated strip 150 of inelastic flexible material. The loop 156 of inelastic flexible material is coupled and slidably movable about the ring 104 at a forward portion 158 thereof. The forward artificial ligament 128 extends at an obtuse angle to the upper artificial ligament 124 and at an acute angle to the lower artificial ligament 126, whereas the lower and upper artificial ligament 216, 214 remain in a vertical position.

Figure 3:
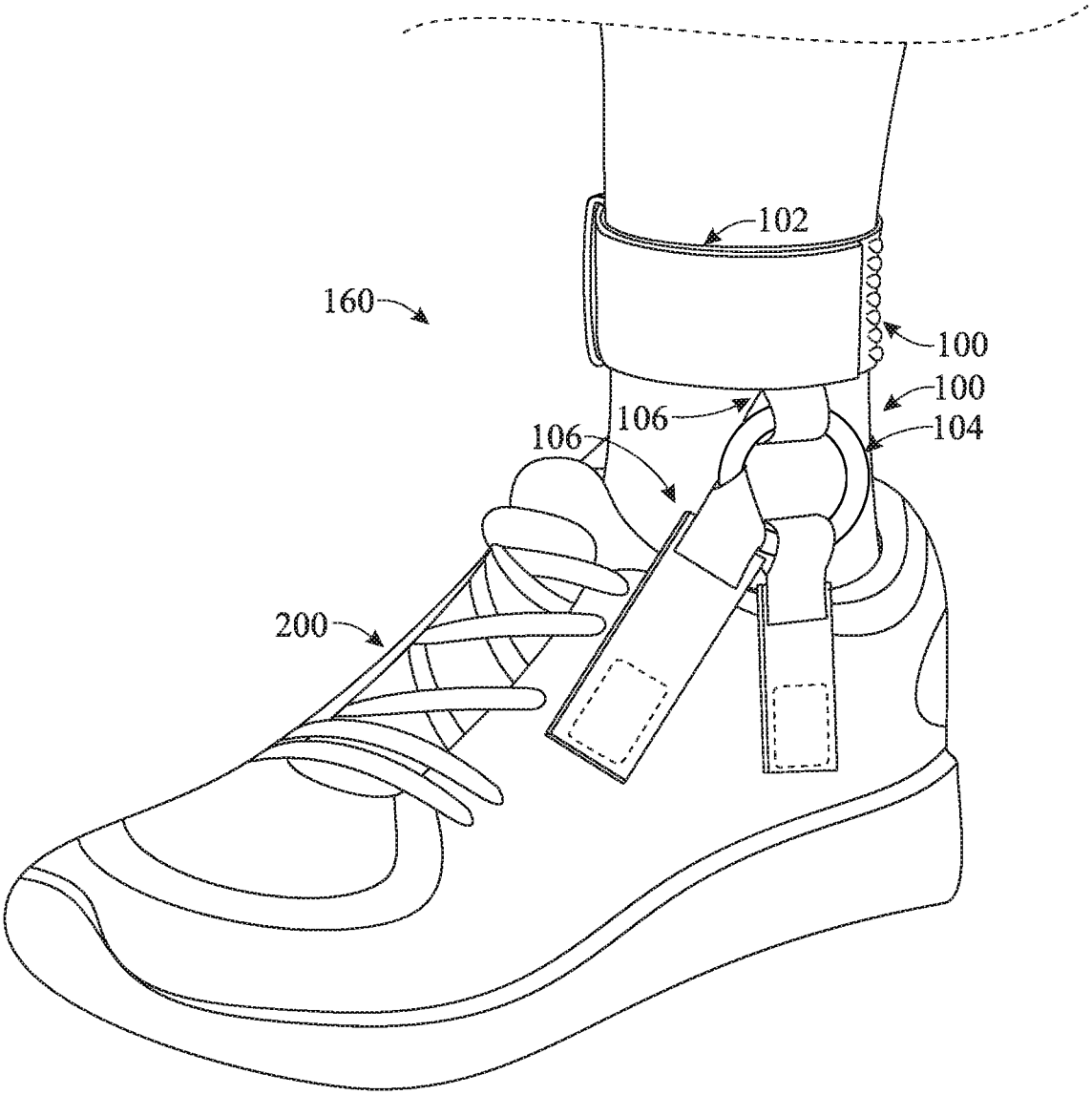
FIG. 3 presents an isometric view of the device now illustrated with its elongated flexible band in fastened condition about the lower leg of the wearer.
Figure 4:
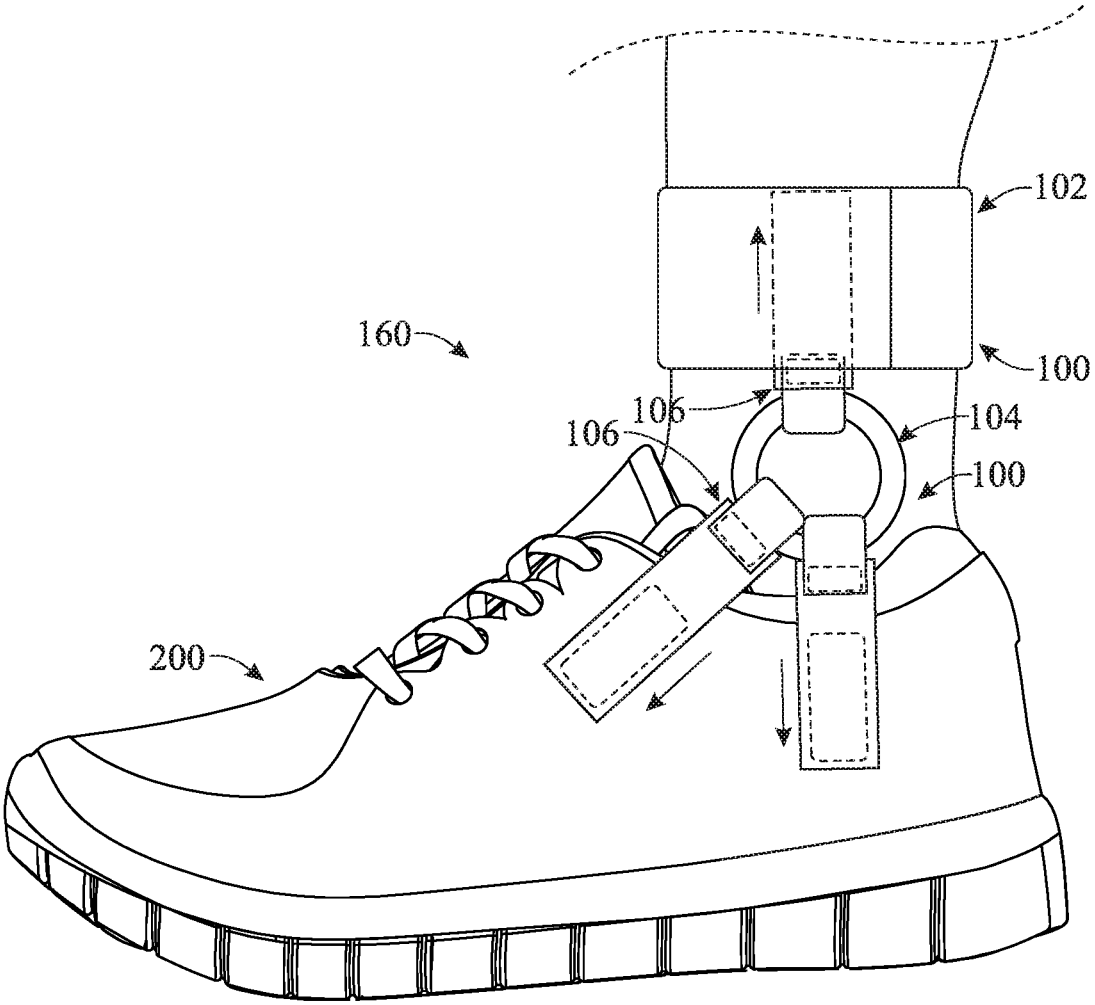
FIG. 4 presents a side elevation view of the device as seen in FIG. 3 now illustrated resisting the forces, as represented by arrows, which are generated during an external rotation at the ankle caused by a turning of the foot outwardly, that may result in a sprained ankle joint.
Figure 5:
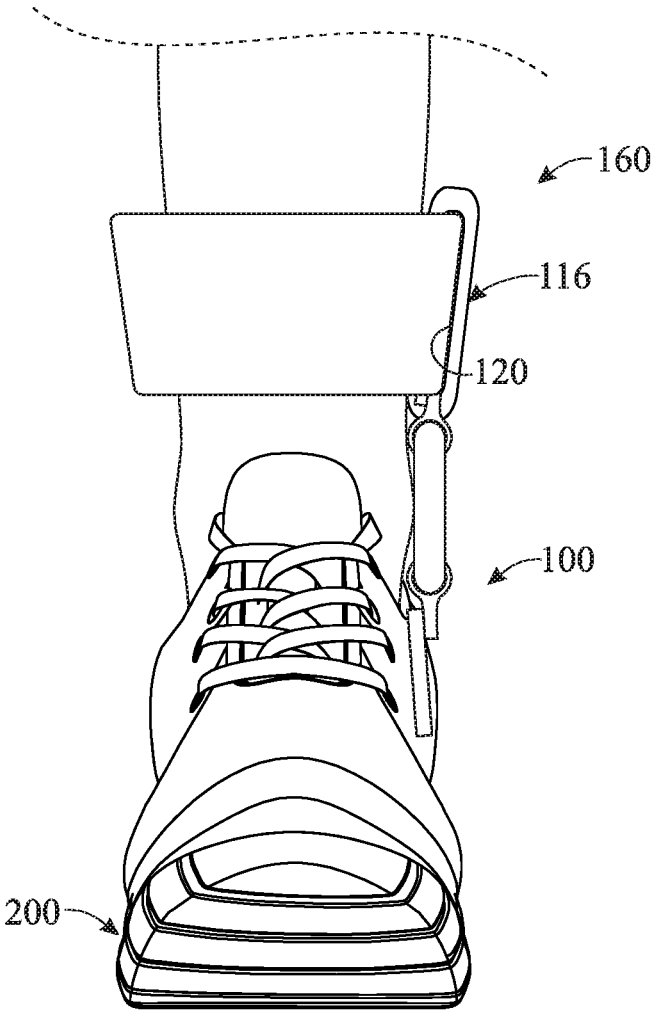
FIG. 5 presents a front view of the device as illustrated in FIG. 4.

Referring to FIGS. 2-5, there is illustrated an exemplary embodiment of an athletic footwear artificial ligament apparatus, generally designated 160, wherein the lower and forward artificial ligaments 126, 128 of the athletic footwear artificial ligament device 100 are illustrated permanently attached, such as by stitching or gluing, to the athletic shoe 200. In FIG. 2, the elongated flexible band 102 of the device 100 is illustrated applied about the lower leg 302 and above the ankle 304 of the wearer, but its end portion 118 is in an unfastened condition with respect to the adjacent portion 122 of the elongated flexible band. In FIGS. 3-5, the end portion 118 is in a secured condition with respect to the adjacent portion 122 wherein the adjacent patches of hook and loop materials 112, 114 are detachably attached to one another. Note also that the first end 132 of the upper elongated strip 130 of inelastic flexible material of the upper artificial ligament 124, which is attached, such as by stitching or gluing, to the elongated flexible band 102, is covered by the attached end portion 118 of the elongated flexible band 102.

Figure 6:
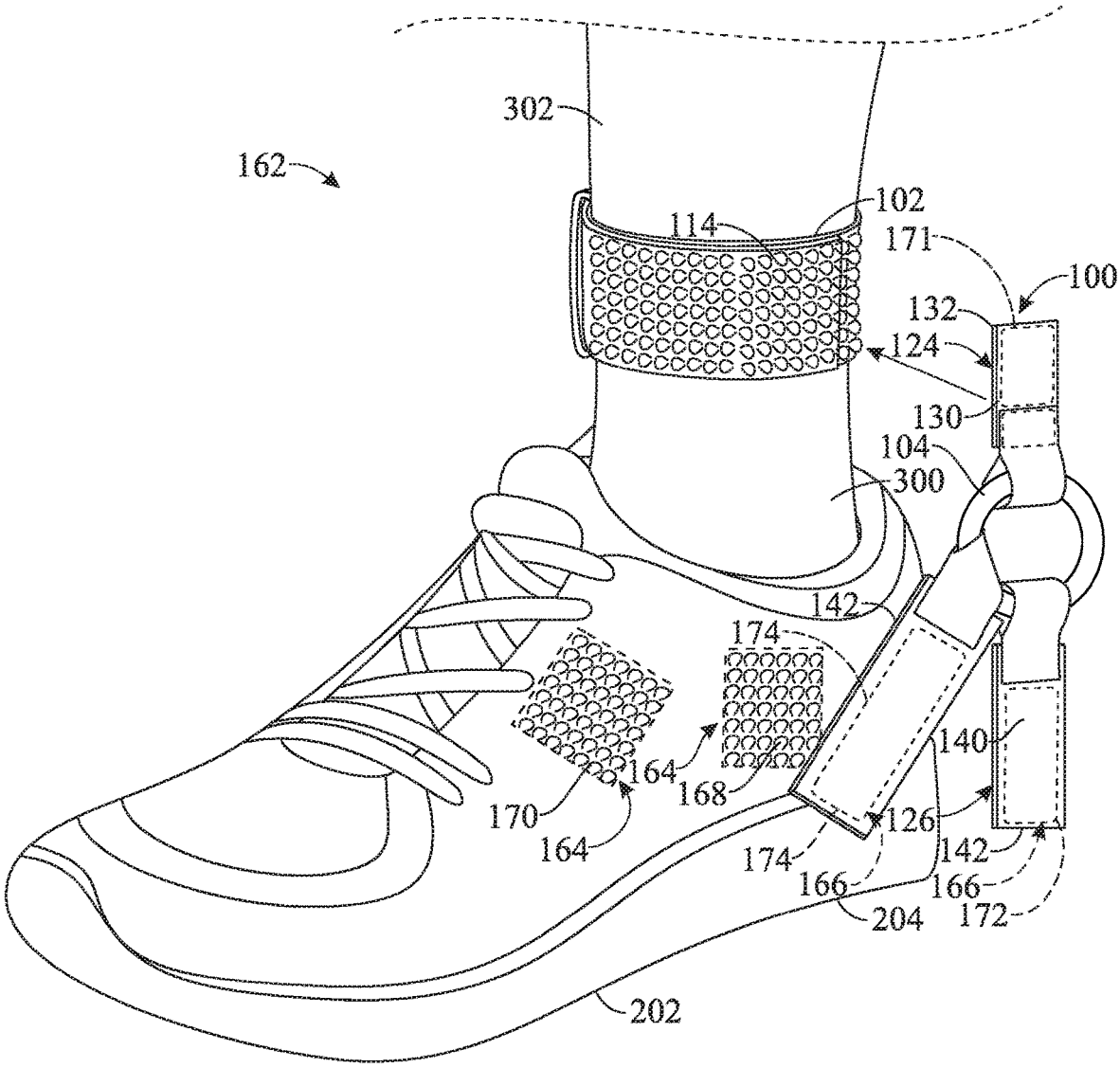
FIG. 6 presents an isometric view of a modified exemplary embodiment of an athletic footwear artificial ligament apparatus wherein the device is detachably attachable to athletic footwear in accordance with aspects of the present invention.
Figure 7:
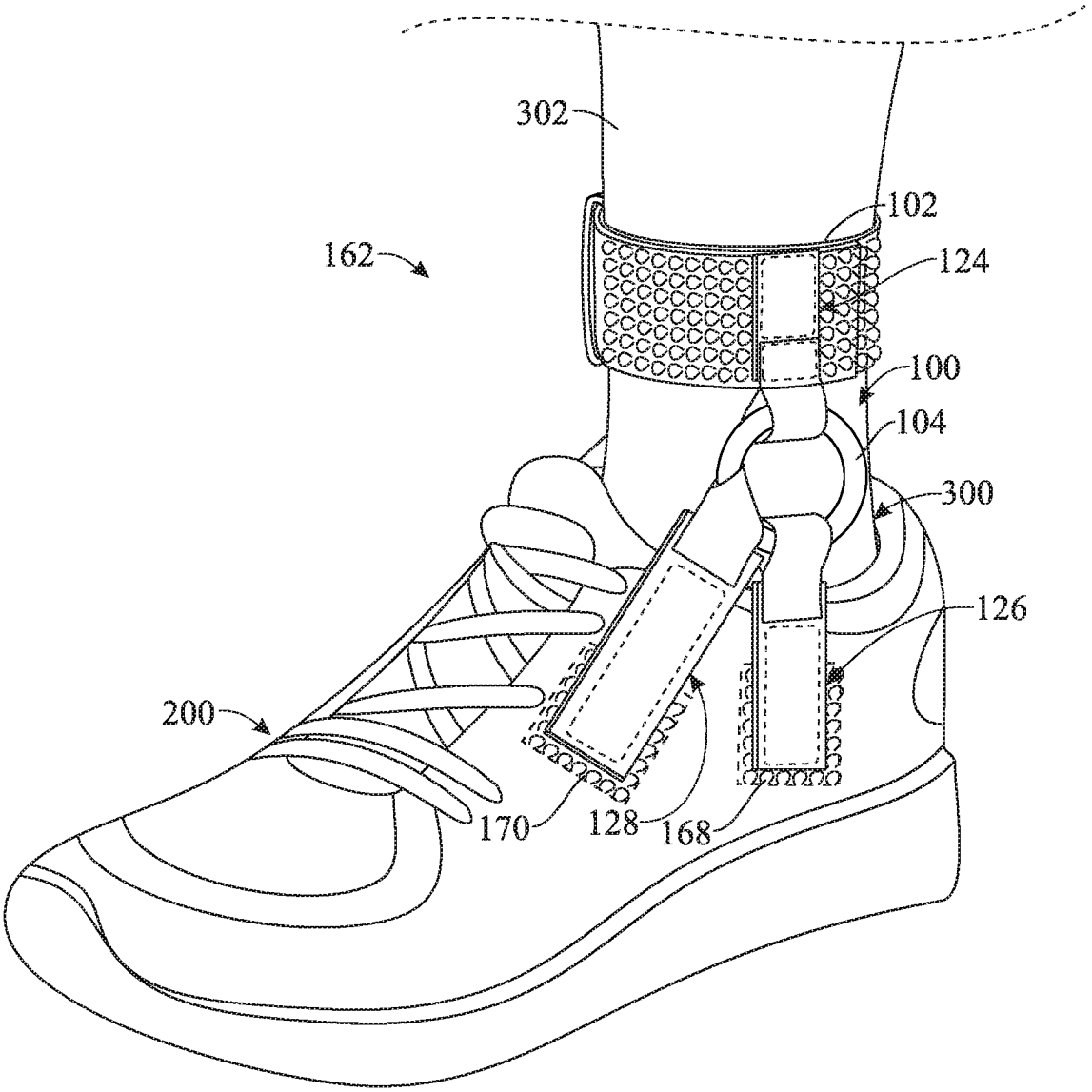
FIG. 7 presents an isometric view of the apparatus of FIG. 6.

Referring to FIGS. 6 and 7, there is illustrated a modified exemplary embodiment of an athletic footwear artificial ligament apparatus, generally designated 162, wherein the upper, lower and forward artificial ligaments 124, 126, 128 of the athletic footwear artificial ligament device 100 are illustrated detachably attach to the athletic shoe 200. The device 100 has the same elongated flexible band 102, ring 104 and plurality of artificial ligaments 106 as described hereinbefore. In addition thereto, the athletic shoe 200 of the modified apparatus 162 has a plurality of first connectors 164, and the device 100 of the modified apparatus 162 has a plurality of second connectors 166. One connector 168 of the plurality of first connectors 164, being in the form of a patch of loop material, is attached, such as by stitching or gluing, on the upper 206 of the athletic shoe 200 adjacent to the sole 202 and above the heel 204. The other connector 170 of the plurality of first connectors 164, also being in the form of a patch of loop material, is attached, such as by stitching or gluing, on the upper 206 of the athletic shoe 200 forwardly of the ring 104 and above the sole 202 and spaced forwardly of the heel 204. One connector 171 of the plurality of second connectors 166, being in the form of a patch of hook material, is attached, such as by stitching or gluing, on the first end 132 of the upper elongated strip 130 of inelastic flexible material of the upper artificial ligament 124 and detachably attached to the patch of loop material 114 on the elongated flexible band 102. Another connector 172 of the plurality of second connectors 166, being in the form of a patch of hook material, is attached, such as by stitching or gluing, on the first end 142 of the lower elongated strip 140 of inelastic flexible material of the lower artificial ligament 126 and detachably attached to the one connector 168 of the plurality of first connectors 164 attached on the upper 206 of the athletic shoe 200 adjacent to the sole 202 and above the heel 204 thereof. Still another connector 174 of the plurality of second connectors 166, also being in the form of a patch of hook material, is attached, such as by stitching or gluing, on the first end of the forwardly-declining elongated strip 142 of inelastic flexible material of the forward artificial ligament 128 and detachably attached to the other connector 170 of the plurality of first connectors 164 attached on the upper 206 of the athletic shoe 200 forwardly of the ring 104, above the sole 202 and spaced forwardly from the heel 204.

To recapitulate, the athletic footwear artificial ligament device 100 protects the ankle from sprain and strain during exercise without constituting a support that limits the normal range of motion (ROM) of the ankle joint. The artificial ligament device 100 intervenes only when the ankle is in danger of exceeding its normal ROM. The artificial ligament device 100 acts as a second, albeit artificial, set of ligaments, which is straightforward to fabricate and is based on the anatomy of the ankle.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A method of protecting an ankle of a foot by resisting forces that may result in a sprained ankle joint, the method comprising:

placing an athletic footwear artificial ligament apparatus on a wearer, the athletic footwear ligament apparatus having an athletic shoe and an athletic footwear artificial ligament device, wherein the process of placing the athletic footwear artificial ligament apparatus on the wearer comprises placing the athletic shoe on the foot of the wearer, wherein the athletic shoe has a sole and an upper, wherein the upper is attached to and extends upwardly from the sole, and wherein the upper includes a first forward connector and a first lower connector, wherein the athletic footwear artificial ligament device has an elongate flexible band, a circular ring, an upper artificial ligament constructed of inelastic flexible material, a lower artificial ligament constructed of inelastic flexible material, and a forward artificial ligament constructed of inelastic flexible material, wherein the upper artificial ligament includes an upper end that is attached to the elongate flexible band and a lower end having a loop, wherein the lower artificial ligament includes an upper end having a loop and a lower end having a second lower connector that is attachable to the first lower connector of the upper of the athletic shoe, wherein the forward artificial ligament includes an upper end having a loop and a lower end having a second forward connector that is attachable to the first forward connector of the upper of the athletic shoe, wherein the process of placing the athletic footwear artificial ligament apparatus on the wearer further comprises securing the elongate flexible band of the athletic footwear artificial ligament device around a lower leg and above the ankle of the wearer, attaching the second lower connector of the lower end of the lower artificial ligament to the first lower connector of the upper of the athletic shoe, and attaching the second forward connector of the lower end of the forward artificial ligament to the first forward connector of the upper of the athletic shoe, wherein the circular ring extends through the loop of the lower end of the upper artificial ligament, through the loop of the upper end of the lower artificial ligament, and through the loop of the upper end of the forward artificial ligament, wherein the loop of the lower end of the upper artificial ligament is slidably moveable about an upper portion of the circular ring, the loop of the upper end of the lower artificial ligament is slidably moveable about a lower portion of the circular ring, and the loop of the upper end of the forward artificial ligament is slidably moveable about a forward portion of the circular ring, wherein the athletic footwear artificial ligament apparatus resists forces generated during an external rotation at the ankle caused by the foot turning outwardly that may result in a sprain of an ankle joint of the wearer, and wherein the athletic footwear artificial ligament apparatus does not limit a normal range of motion (ROM) of the ankle joint.

2. The method of claim 1, wherein the first lower connector of the upper of the athletic shoe is a first patch of loop material, wherein the second lower connector of the lower end of the lower artificial ligament is a first patch of hook material, and wherein the first patch of hook material detachably attaches with the first patch of loop material.

3. The method of claim 1, wherein the first forward connector of the upper of the athletic shoe is a first patch of loop material, wherein the second forward connector of the lower end of the forward artificial ligament is a first patch of hook material, and wherein the first patch of hook material detachably attaches with the first patch of loop material.

4. The method of claim 1, wherein the first lower connector of the upper of the athletic shoe is a first patch of loop material, wherein the second lower connector of the lower end of the lower artificial ligament is a first patch of hook material, wherein the first patch of hook material detachably attaches with the first patch of loop material, wherein the first forward connector of the upper of the athletic shoe is a second patch of loop material, wherein the second forward connector of the lower end of the forward artificial ligament is a second patch of hook material, and wherein the second patch of hook material detachably attaches with the second patch of loop material.

5. The method of claim 1, wherein the elongate flexible band has a patch of hook material on one side of the band and a patch of loop material on an opposite side of the band, and wherein the patch of hook material detachably attaches with the patch of loop material.

6. The method of claim 1, wherein upper end of the upper artificial ligament is attached to the elongate flexible band with stitching.

* * * * *